US005974590A

United States Patent [19]

Stubbs

[11] Patent Number: 5,974,590

[45] Date of Patent: Nov. 2, 1999

[54] PAIR OF SOCKS

[76] Inventor: Michael John Stubbs, North Cerney Manor, North Cerney, Cirencester, Gloucestershire, GL7 7BT, United Kingdom

[21] Appl. No.: 09/077,171

[22] PCT Filed: Nov. 20, 1996

[86] PCT No.: PCT/GB96/02864

§ 371 Date: Aug. 19, 1998

§ 102(e) Date: Aug. 19, 1998

[87] PCT Pub. No.: WO97/19216

PCT Pub. Date: May 29, 1997

[51] Int. Cl.[6] ..... A41D 27/08; A44B 1/14

[52] U.S. Cl. ..... 2/239; 24/90.1; 24/DIG. 29

[58] Field of Search ..... 2/239, 409; 24/662, 24/324, 461, 590, 90.1, 90.5, DIG. 29; 40/633, 159

[56] References Cited

U.S. PATENT DOCUMENTS

| | | | |
|---|---|---|---|
| 4,058,853 | 11/1977 | Boxer et al. . | |
| 4,165,555 | 8/1979 | Boxer et al. . | |
| 4,682,389 | 7/1987 | Callender . | |
| 5,038,413 | 8/1991 | Ursino . | |
| 5,357,660 | 10/1994 | Smith | 24/662 |
| 5,490,309 | 2/1996 | Velasquez et al. | 24/90.1 |

FOREIGN PATENT DOCUMENTS

| | | |
|---|---|---|
| 2196683 | 5/1988 | United Kingdom . |
| WO 91/04684 | 4/1991 | WIPO . |

*Primary Examiner*—Gloria Hale
*Attorney, Agent, or Firm*—Brinks Hofer Gilson & Lione

[57] ABSTRACT

A pair of socks 10 wherein each sock comprises a connector 16 operably attached thereto wherein each connector comprises locking means 42, 38 for co-operative locking with the other connector. Each connector 16 comprises a first and second member 22, 24, 26, 28 attachable to one another on opposite sides of a region of sock fabric wherein the first member 24, 26 of the first and second connectors respectively comprise said first and second locking means 42, 38 and the second members 22, 28 of the first and second connectors comprise a surface 54 for a design. The first member 24, 26 of each connector 16 is positioned on the inside of the sock and the second member 22, 28 of each connector 16 is positioned on the outside of the sock in the socks usual configuration for wear.

10 Claims, 2 Drawing Sheets

PAIR OF SOCKS

The invention relates to a pair of socks and to connectors for joining socks in a pair.

It is recognised that there is considerable difficulty for wearers of socks in retaining two socks belonging to a pair together throughout the process of washing and storing the socks after use.

In order to overcome this problem and difficulties associated in easily keeping pairs of socks together, it is known to provide a sock connector comprising a plate having two holes through each of which parts of a sock can pass. The rim of the holes comprises a series of resilient webs which allow easy insertion of a sock into the aperture by a user but which grip the sock sufficiently to inhibit removal for example in a washing machine. However, such known devices present the user with a problem of fist locating such a device, some time after removal of a pair of socks, before the socks can be connected. Secondly, the device is rather large requiring significant material for manufacture and also taking up a significant amount of storage space compared to the size of the pair of socks.

Ursino in U.S. Pat. No. 5,038,413 provides a fastening device for a pair of socks, each fastener comprising a first element having axial spikes passing through the sock fabric, a reinforcement material positionable between the first element and the sock, and an outer part attachable to the spikes and comprising, locking means for cooperating with its respective opposite outer part thereby to enable the socks to be fastened together. The fastener device further comprises detachable covers having on one surface a design and on the other surface means for connecting to the outer part of the sock fasteners when the socks are not connected. However, such covers are easily lost and need to be added to the fasteners after washing thereby causing the user inconvenience.

The invention seeks to avoid or at least mitigate the problems of the prior art. According to one aspect of the invention there is provided a pair of socks comprising a first sock operably having a first connector and a second sock operably having a second connector which first and second connectors respectively comprise first and second locking means for releasably and cooperatively locking the connectors together each connector comprising a first and second member attachable to one another on opposite sides of a region or sock fabric wherein the first member of the first and second connectors respectively comprise said first and second locking means and the second members of the first and second connectors comprise a surface for a design and wherein the first member of each connector is positioned on the inside of the sock and the second member of each connector is positioned on the outside of the sock in the socks usual configuration for wear.

Preferably, the surfaces for the designs are integral with the second members. Also, the first and second locking means can comprise a lug and a recess wherein the lug is adapted releasably to lock into the recess. The lug can comprise an annulus having a resilient outer flange. The fist and second members can comprise means for releasably and cooperatively locking together. The member locking means preferably comprises a lug and a recess. The lug can be a tab or pin which can pass through the fabric of a sock without damage thereto. The connectors are preferably made of plastics material.

Another aspect of the invention provides a connector comprising two members each comprising cooperating member locking means thereby to enable the members releasably to attach to a sock. The member locking means preferably comprises a tab or pin which can pass through the fabric of the sock without damage thereto, thereby to enable the members to lock together on opposite sides of the sock fabric.

An embodiment of the invention will now be described, by way of example only, with reference to the accompanying drawings, in which.

Figure 1:
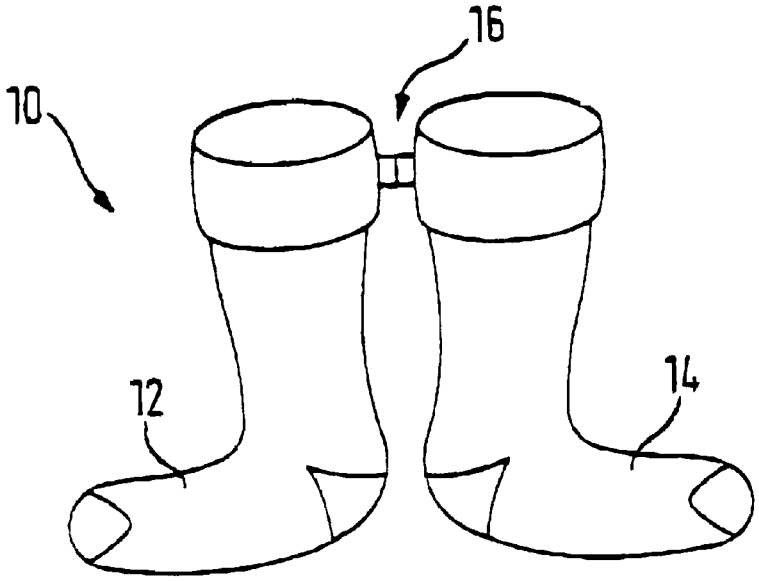
FIG. 1 is a schematic perspective view of a pair of socks according to the invention.

FIG. 1 shows a pair socks 10 according to the invention comprising a first and second sock 12 and 14 respectively, and a connector 16 connecting the socks together.

Figure 2:
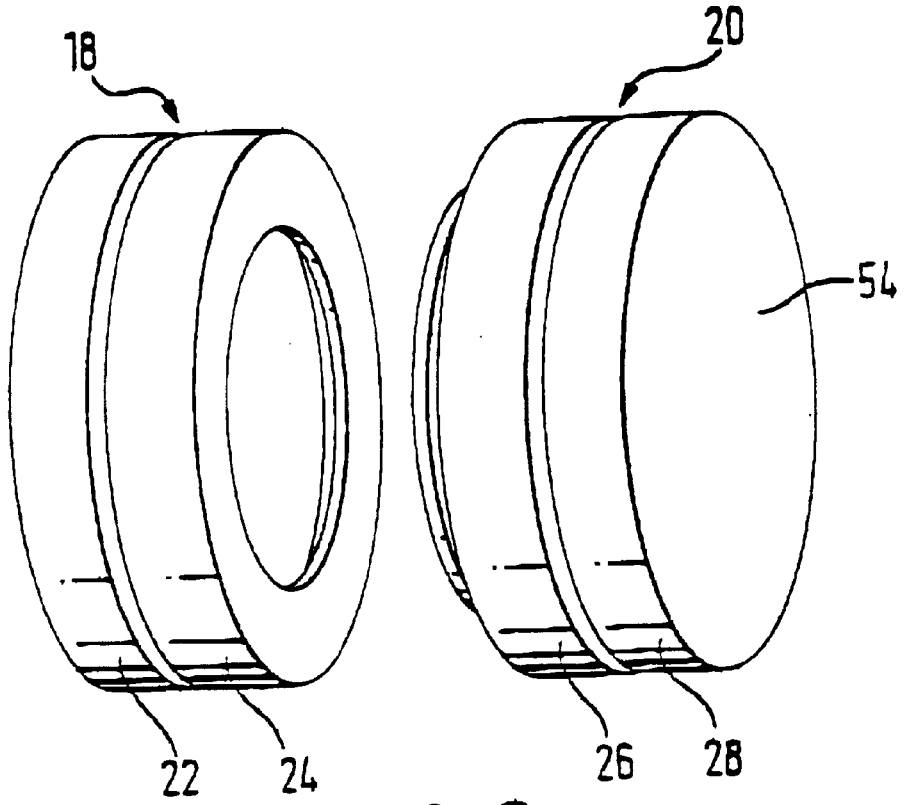
FIG. 2 is a schematic perspective view of a connector according to the invention.

In this embodiment, the connector 16 comprises a first part 18 and second part 20 each comprising two members as shown in FIG. 2. Accordingly, connector 16 comprises members 22, 24, 26 and 28 wherein members 22 and 24 are releasably connectable to one another to form first connector part 18 and members 26 and 28 are releasably connectably together to form second connector part 20.

Figure 3:
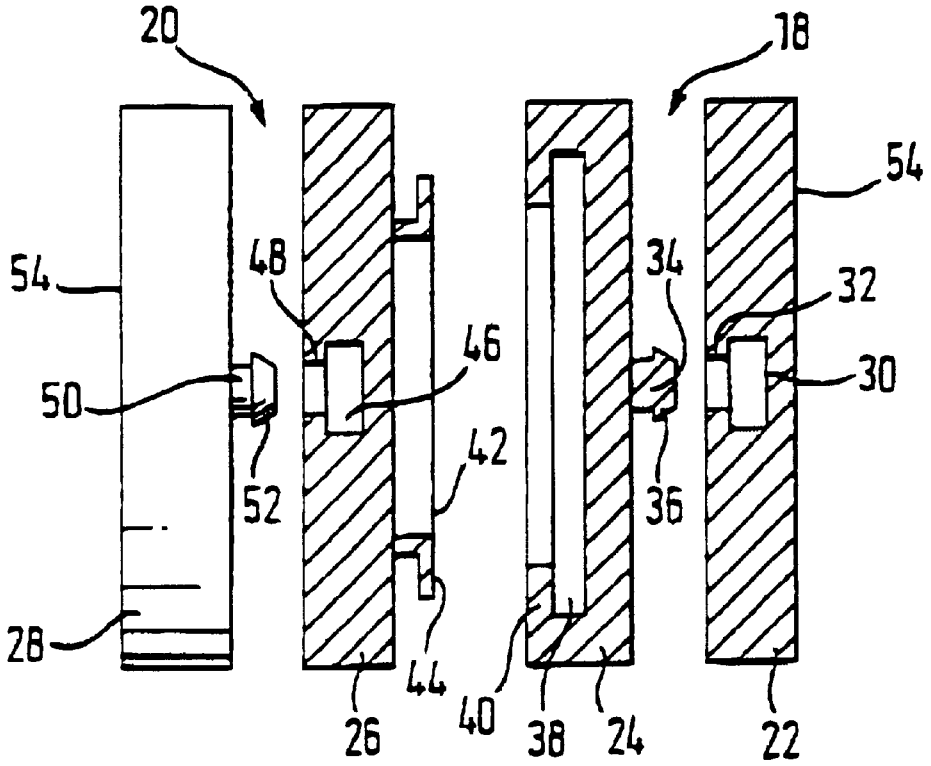
FIG. 3 is a sectional side elevation view of the connector shown in FIG. 2.

Referring to FIG. 3, there is shown an example of how the members can be connected together. Accordingly, member 22 can comprise a recess 30 having an outermost rim 32 of relatively narrow diameter, whilst member 24 can comprise a lug 34 comprising outermost shoulders 36 for cooperating with the inner edge of rim 32 after lug 34 passed into recess 30. Similarly, members 26 and 28 can comprise recess 46 comprising rim 48 and lug 50 comprising locking shoulder 52. Of course, the lug or recess can be positioned on either one of the members in a cooperating pair.

To attach the members to a sock, lugs 34 and 50 which can effectively be very small pins, are passed through the layer of material making up the sock before insertion into recesses 30 and 46 respectively. By keeping lugs 34 and 50 relatively small, there need not be any damage to the material when attaching a pair of members together.

Additionally, member 24 comprises a recess 38 having an outer rim 40 of relatively small diameter. Member 26 comprises a locking annulus 42 comprising an outer flange 44 for cooperating with the inner surface of rim 40 when annulus 42 is passed into recess 38.

Figure 4:
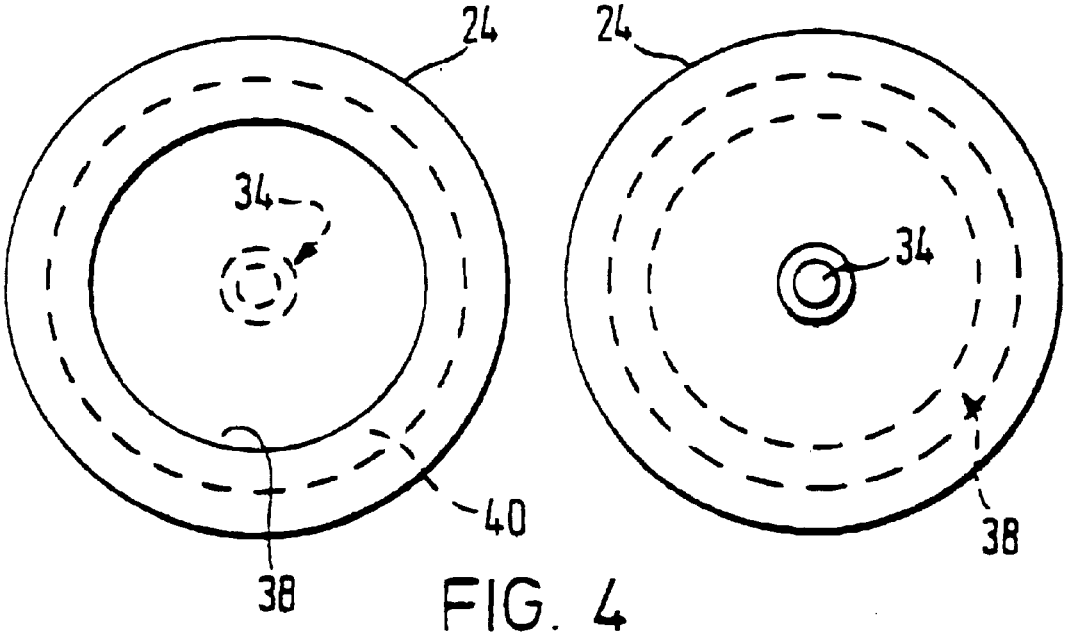
FIG. 4 is a pair of end elevation views of one of the members of the connector shown in FIGS. 2 and 3.

Further views of member 24 are shown in FIG. 4 which show end elevation views of this member. The right-hand view is a right-hand end elevation with respect to FIG. 3, and the left-hand view is a left-hand end elevation of the view shown in FIG. 3.

The members 22 to 28 of connector 16 preferably are made of plastics material and can be injection moulded for example. Thus, lugs 34 and 50 annulus 42 and rims 32, 48 and 40 of the recesses can be resilient enabling insertion, locking and removal of the various cooperating features.

Preferably each member has a outmost diameter in the order of a few millimeters. Accordingly, parts 18 and 20 can be comfortably located for example at the upper rear part of a sock in order not to cause the wearer any discomfort during use of a pair of socks 10. Beneficially each part 18 and 20 can comprise an outer smooth surface 54 which can carry a logo or other image enabling advertising or character merchandising. In order to present surface 54 to the outside of the sock in use, members 24 and 26 which cooperate with one another to keep a pair of socks together, should be placed on the inside portion of a sock. The top of the sock can then be rolled over as shown in FIG. 1 to enable the members 24 and 26, and thus parts 18 and 20 of connector 16, to lock together. Alternatively, surface 54 can be presented to the inside of the sock in use and can be shaped to contour the surface of the adjacent body part such as the heel or Achilles tendon for example. In a further alternative the annulus 42 and rim 40 can be shaped for example having a curved surface in the form of a groove to contour part of the heel or lower leg of a user.

I claim:

1. A pair of socks comprising a first sock having a first connector and a second sock having a second connector, the first and second connectors respectively including first and second locking means for releasably and cooperatively locking the connectors together, each of the first and the second connectors comprising a first and second member attachable to one another on opposite sides of a region of sock fabric, the first members of the first and second connectors including the first and second locking means and the second members of the first and second connectors including a surface for a design, the first member of each of the connectors being positioned on the inside of the socks and the second member of each of the connectors being positioned on the outside of the socks in the socks usual configuration for wear.

2. A pair of socks according to claim 1 wherein the surfaces for the design are smooth and integral with the second members.

3. A pair of socks according to claim 1 wherein the first and second locking means comprises a lug and a recess wherein the lug is adapted releasably to lock into the recess.

4. A pair of socks according to claim 3 wherein the lug comprises an annulus having a resilient outer flange.

5. A pair of socks according to claim 1 wherein the first and second members comprise means for releasably and cooperatively locking together.

6. A pair of socks according to claim 5 wherein the member locking means comprises a lug and a recess.

7. A pair of socks according to claim 6 wherein the lug is a tab or pin which can pass through the fabric of a sock without damage thereto.

8. A pair of socks according to claim 1 wherein the connectors are made of plastics material.

9. A pair of socks according to claim 1 having a connector comprising two members each comprising cooperating member locking means thereby to enable the members releasably to attach to a sock.

10. A pair of socks according to claim 9 wherein the member locking means comprises a tab or pin which can pass through the fabric of the sock without damage thereto to enable the members to lock together on opposite sides of the sock fabric.

* * * * *